US005511145A

United States Patent [19]

Bailey et al.

[11] Patent Number: 5,511,145

[45] Date of Patent: Apr. 23, 1996

[54] PORTABLE ELECTRIC HEATER OR FLOOR LAMP

[76] Inventors: Ralph E. Bailey, 5 F Lockhart Cir.; Thomas P. Jeffords, Sr., 2243 Rocks Spring Rd., both of Forest Hill, Md. 21050

[21] Appl. No.: 152,689

[22] Filed: Nov. 16, 1993

[51] Int. Cl.[6] ..... F24H 1/00

[52] U.S. Cl. ..... 392/355; 219/220

[58] Field of Search ..... 392/355, 356; 219/220

[56] References Cited

U.S. PATENT DOCUMENTS

| | | |
|---|---|---|
| 1,547,160 | 7/1925 | Bailey . |
| 1,755,204 | 4/1930 | Buffalow et al. . |
| 1,926,473 | 9/1933 | Wood . |
| 2,379,705 | 7/1945 | Graves . |
| 2,938,101 | 5/1960 | Burzner . |
| 3,104,307 | 9/1963 | Garofalow et al. . |
| 3,575,582 | 4/1971 | Covault . |
| 4,309,594 | 1/1982 | Jones . |

FOREIGN PATENT DOCUMENTS

| | | | |
|---|---|---|---|
| 135371 | 12/1949 | Australia | 392/355 |
| 308388 | 3/1989 | European Pat. Off. | 392/355 |
| 1502839 | 11/1967 | France | 392/355 |
| 2442409 | 6/1980 | France | 392/355 |
| 2504768 | 4/1981 | France | 392/356 |
| 3226 | of 1908 | United Kingdom | 392/355 |

*Primary Examiner*—John A. Jeffery

[57] ABSTRACT

A portable electric heating or lighting fixture that uses infrared radiation to heat air efficiently, which is uniquely configured with no moving parts, having both fixed and removable ideal black body surfaces (28), (40), (42), (44), and a plurality of air convection chambers (30), (34), (38), that surround a replaceable radiant energy infrared or quartz heating lamp (24). In the lighting mode of operation, replaceable clear or colored incandescent lamps (98), or compact fluorescent lamps (100), are used for decor and indirect lighting applications. Decor matching fabric or fiber skirts and sleeves, silk screening, decals and paint can be used to decorate the exterior surface of outer pipe (36). Circular shaped colored glass or plastic panels can placed on air outlet register (58) for unlimited lighting effects. Natural resources and electricity can be conserved with this combination portable electric heater or floor lamp fixture.

5 Claims, 8 Drawing Sheets

PORTABLE ELECTRIC HEATER OR FLOOR LAMP

BACKGROUND

1. Field of Invention

Our invention relates to an electric heater which uses radiant energy to heat air, specifically employing a thermally pressurized air chamber and one or more convection air chambers communicating to an upwardly positioned air mixing chamber, wherein the transfer efficiency of energy is substantially increased.

2. Description of Prior Art

Infrared heaters have been known for years but a continuing problem with these heaters has been the inefficiency thereof. Prior art has failed to recognize, identify, incorporate the various heat capacities of air that generate thermally pressurized air. The prior art includes U.S. Pat. No. 3,575,582 issued to D. W. Covault on Apr. 20, 1971. This patent shows an electrical furnace comprising a cabinet structure, a plurality of lamps, a fan assembly and a heat exchanger consisting of a plurality of prong shaped heat transmitting elements attached to it. In this furnace, air is circulated by the fan assembly through and around the heat exchanger such that it is capable of absorbing heat from the heat exchanger and heat transmitting elements. The heated air is then forced out of the furnace through a louver in the top of the device. Other references representative of the prior art include the following: U.S. Pat. No. 1,480,362, issued to Anderson on Jan. 8, 1924; U.S. Pat. No. 1,547,160, issued to Bailey on Jul. 28, 1925; U.S. Pat. No. 1,755,204, issued to Buffalow et al. on Apr. 22, 1930; U.S. Pat. No. 1,926,473, issued to Wood on Sep. 12, 1933; U.S. Pat. No. 2,087,240, issued to Brown on Jul. 20, 1937: U.S. Pat. No. 2,379,705, issued to Graves on Jul. 3, 1945; U.S. Pat. No. 2,938,101, issued to Borzner on May 24, 1960; U.S. Pat. No. 3,104,307, issued to Garofalow et al. on Sep. 17, 1963; and U.S. Pat. No. 4,309,594 issued to Jones on Jan. 5, 1982.

BRIEF SUMMARY OF INVENTION

With the present invention there is provided a highly efficient portable electric heater or floor lamp consisting of certain improvements which overcome all of the disadvantages of aforementioned heaters.

One object of the invention is to provide a portable electric heater or floor lamp when employed as a heater, utilizes a thermally pressurized air chamber which contributes to transform radiant energy into heat energy.

A further object of this invention is to provide a portable electric heater or floor lamp when employed as a heater utilizes the embodied optimum focus position wherein the greatest absorption of the total spectral distribution of energy occurs.

A further object of the invention is to provide a portable electric heater or floor lamp when employed as a heater, wherein efficient transfer of radiant energy to heat energy is substantially increased by the heat conductive casing, discs and air diffusers being proportionally sized to the wattage rating of the radiant energy source.

A further object of the invention is to provide a portable electric heater or floor lamp when employed as a floor lamp illuminates a room with sufficient light.

A further objective of the invention is to provide one or more convection air chambers communicating to an upwardly positioned air mixing chamber wherein the transfer efficiency of is substantially increased.

A further object of the invention is to provide the foregoing features in a portable electric heater or floor lamp which is simple, durable, inexpensive and ultra efficient.

Other and further objects and advantages of the invention will become apparent from a consideration of the drawings and ensuing description.

DRAWING FIGURES

DESCRIPTION—FIGURES 1 TO 5

Figure 1:
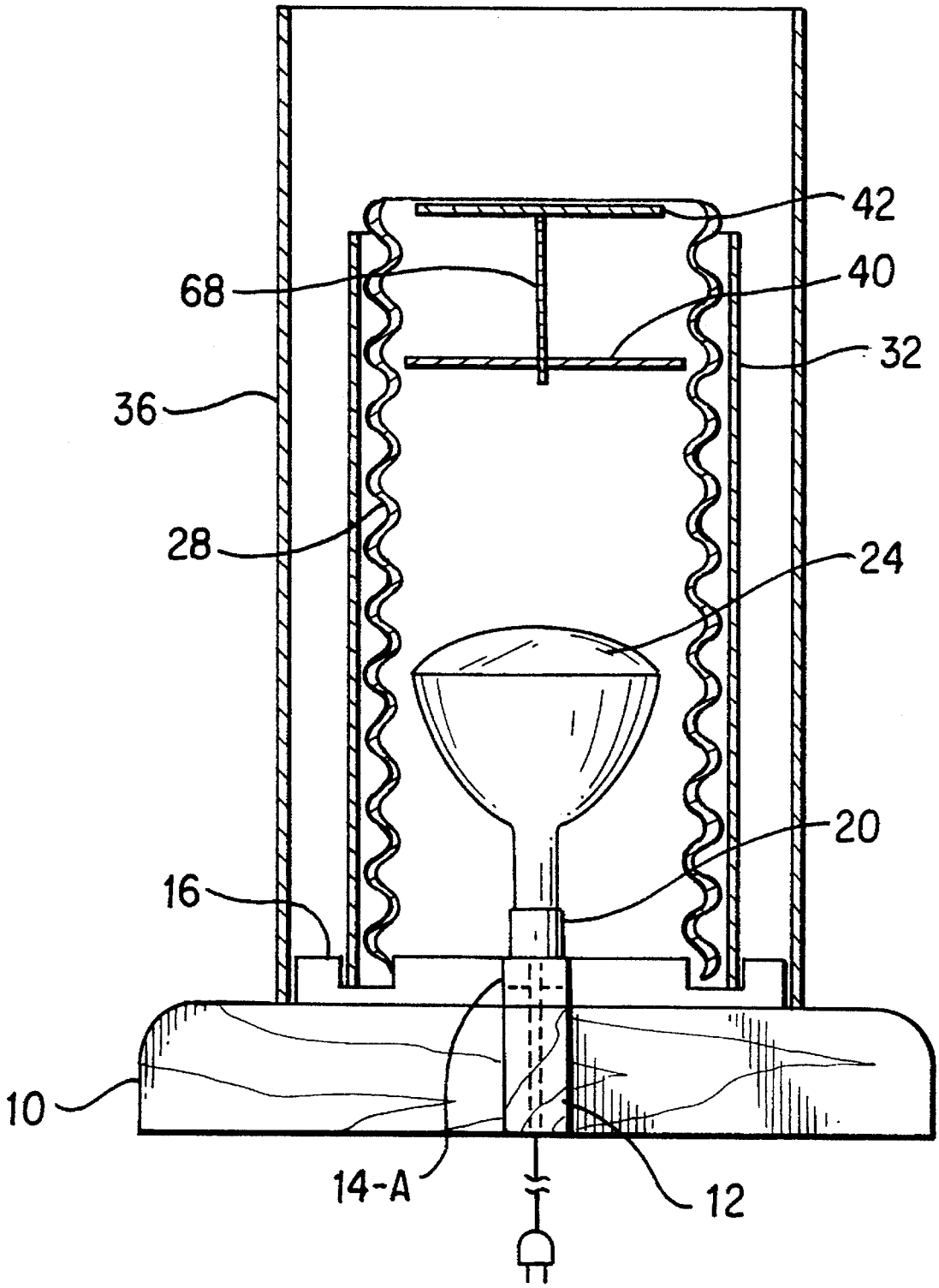
FIG. 1 shows a sectional view of the inner pipe, lamp and air diffuser in the electrical heater configuration.

A preferred embodiment of our Portable Electric Heater or Floor Lamp of the present invention is illustrated in FIG. 1 (partial sectional view).

Figure 2:
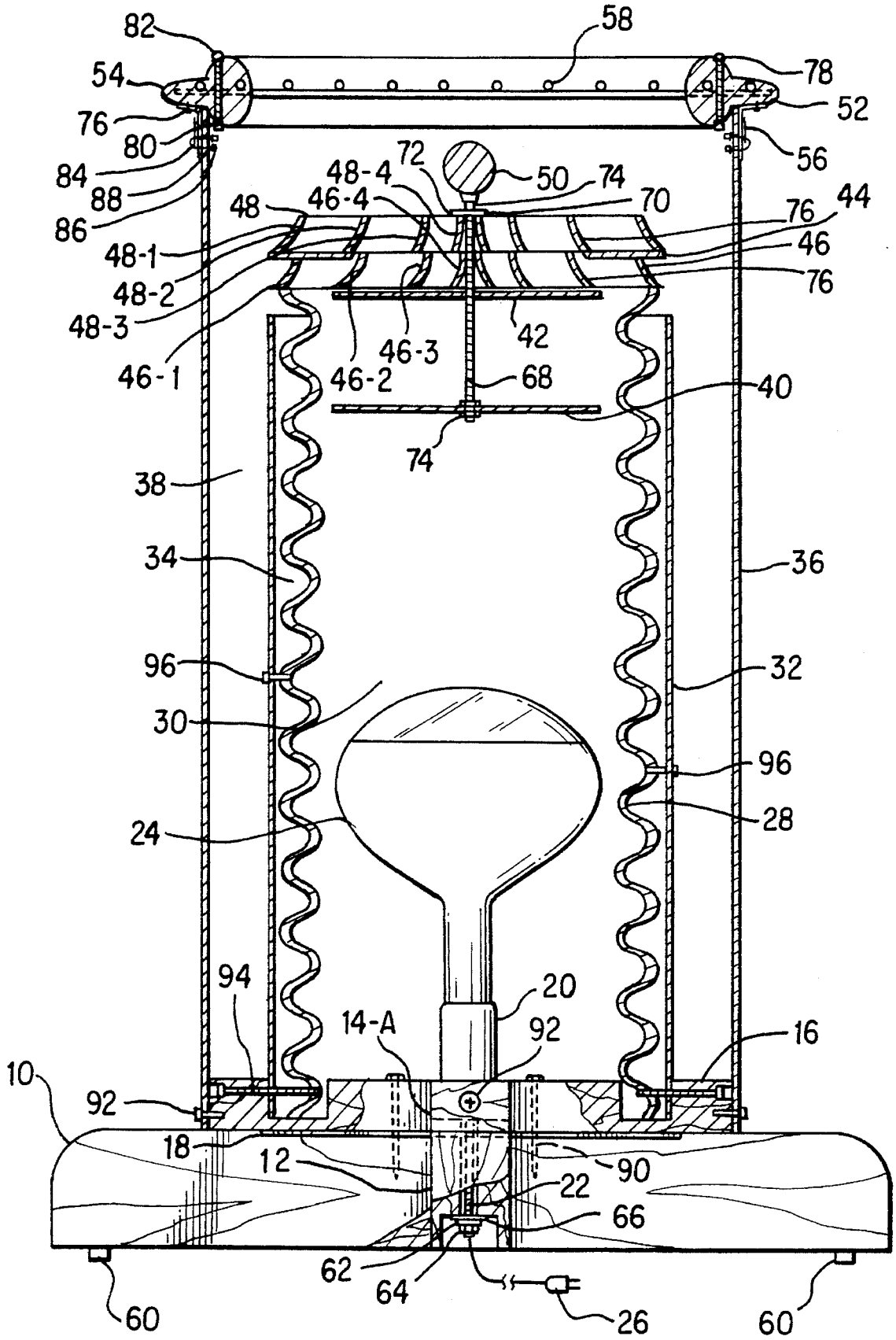
FIG. 2 shows a sectional view of the invention in the electrical heater configuration.
Figure 4:
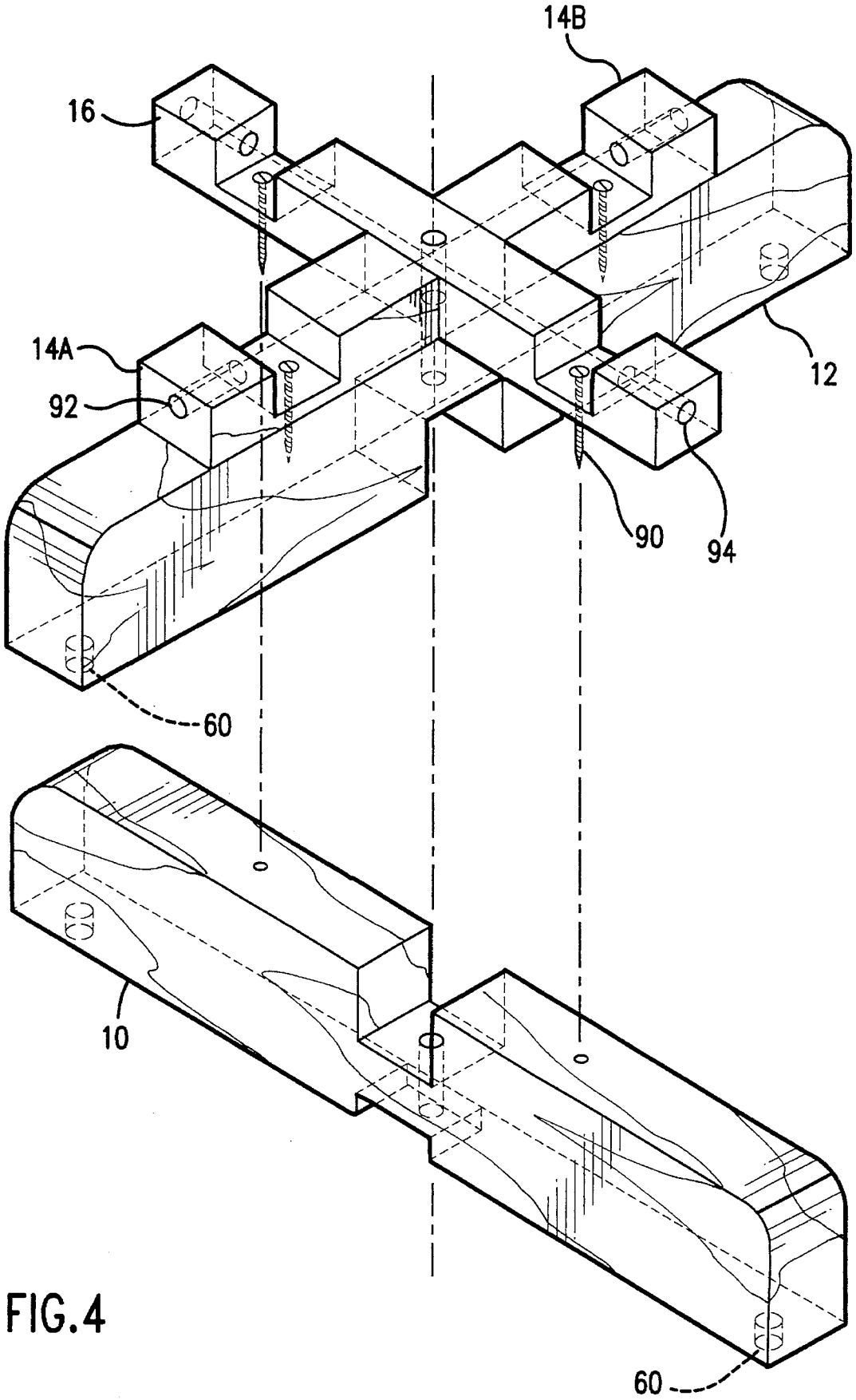
FIG. 4 shows an exploded view of the pedestal base assembly.

FIG. 2 (sectional view), is a typical embodiment of the portable electric heater and floor lamp. A two part wooden pedestal 10 and 12 (FIG. 4), interlock with one another and at their respective center lines. A plurality of feet 60, attach to the underside of each of the four pedestal legs. An intake air diffuser 18 is centered and placed on pedestal 10 and 12. An outer pipe mount 16 is centered and placed on intake air diffuser 18. Both are attached to pedestal 10 with a plurality of screws 90. Outer pipe mount 16 allows for non-critical alignment and ease of assembly for outer pipe 36 and provides additional mechanical strength to pedestals 10 and 12. The top surface of an outer pipe mount 16 is bored out and keyed to receive the base of a porcelain lamp socket 20. An inner pipe mount 14A and an inner pipe mount 14B are placed on intake air diffuser 18 and secured to pedestal 12 with a plurality of screws 92. Inner pipe mounts 14A, 14B provide non-critical alignment and ease of assembly of a middle pipe 32 and an inner pipe 28. They also provide additional mechanical strength to pedestals 10 and 12.

An electrical conduit 22 is threaded onto a base of porcelain lamp socket 20 and inserted into the center hole of outer pipe mount 16 from the top. A washer 66, a locking nut 62 and a safety grommet 64 are threaded onto the other end of electrical conduit 22 and tightened. This adds additional mechanical strength to pedestals 10 and 12. A line cord 26 is inserted into electrical conduit 22 from the bottom and is connected to the electrical terminals of porcelain lamp socket 20.

Figure 5:
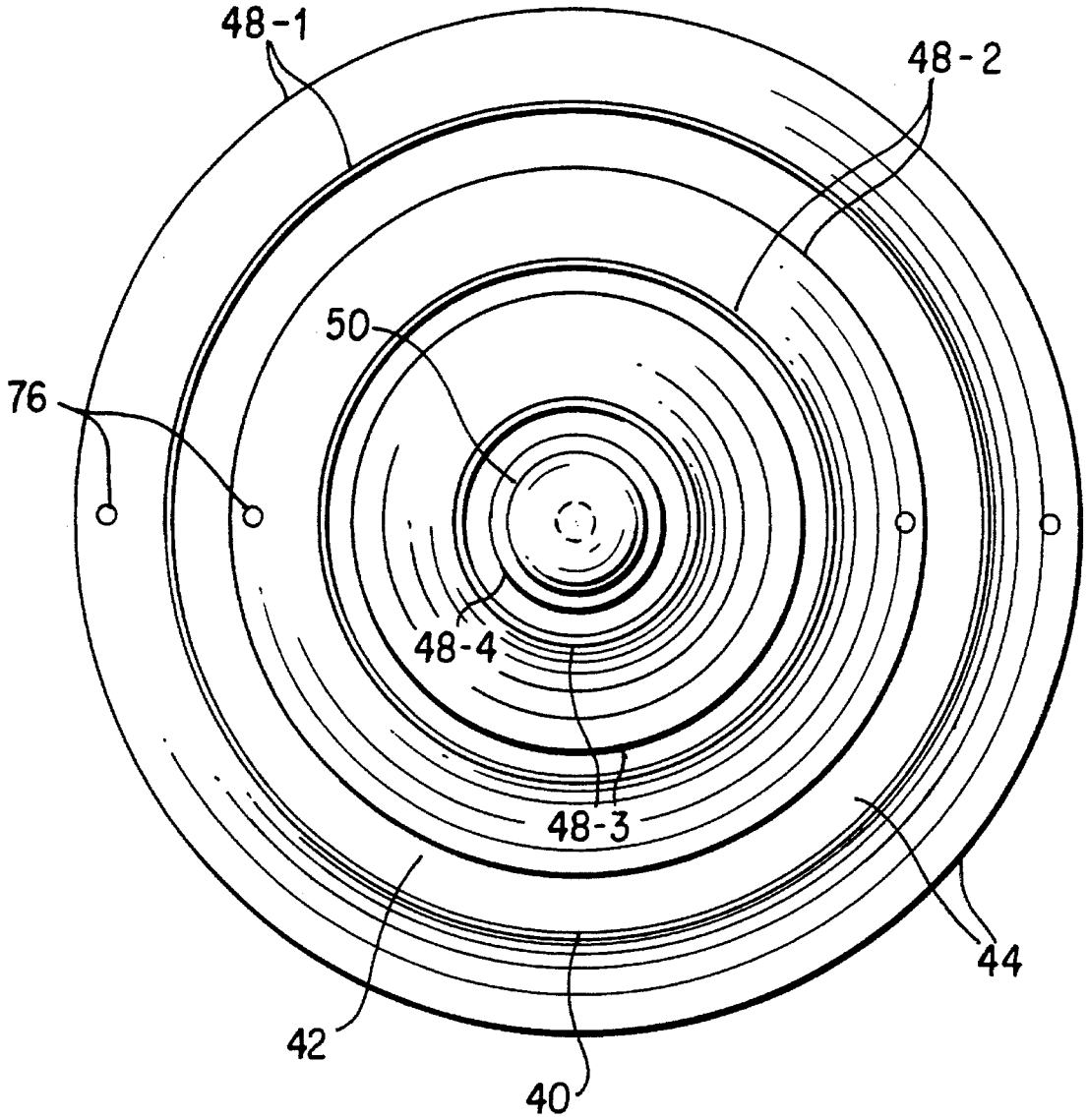
FIG. 5 shows a plan view of the manually detachable heat conductive discs and heat conductive air outlet diffusers employed in the electrical heater configuration.
Figure 6:
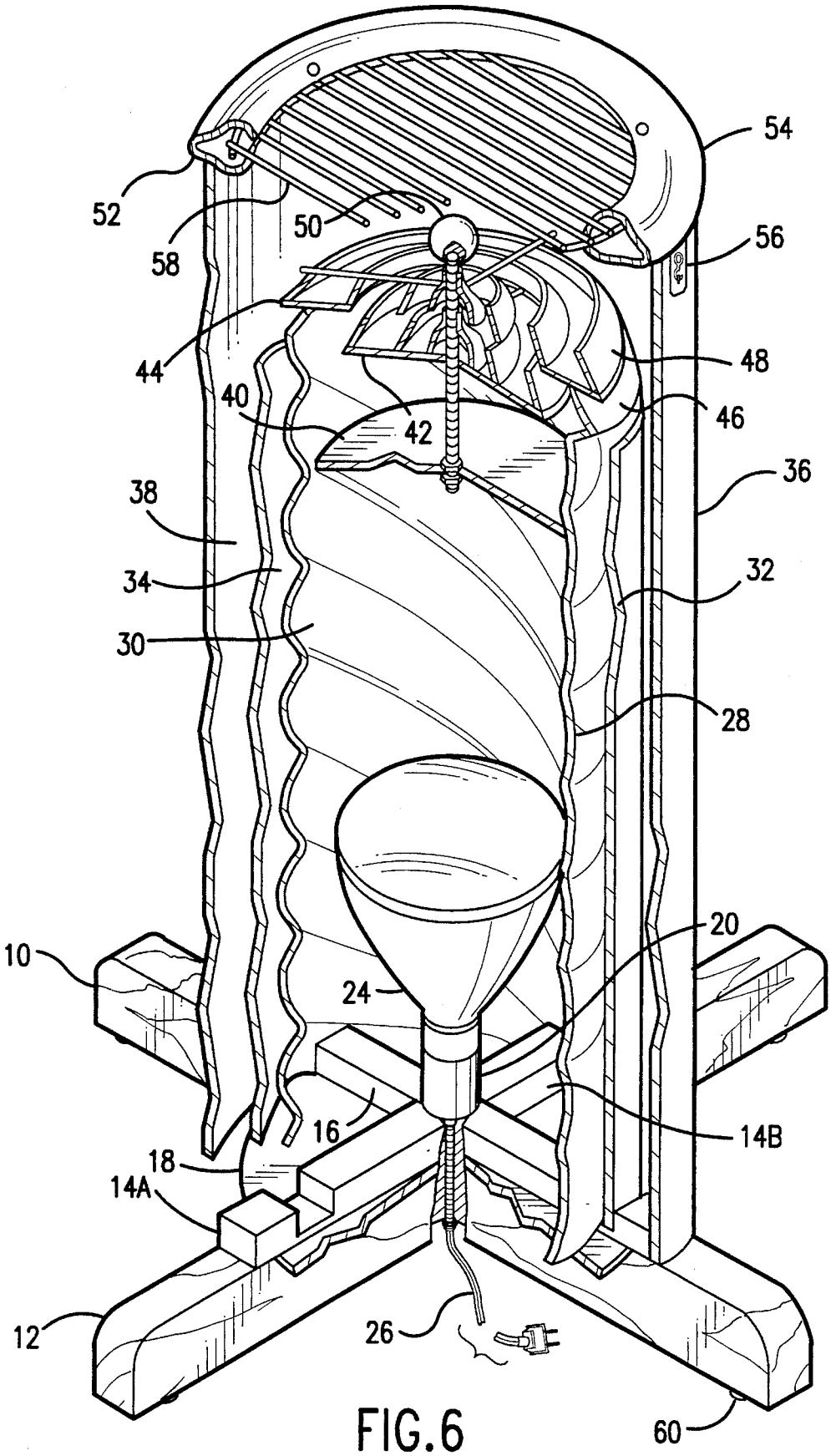
FIG. 6 shows a cut away view of the invention in the electrical heater configuration.
Figure 7:
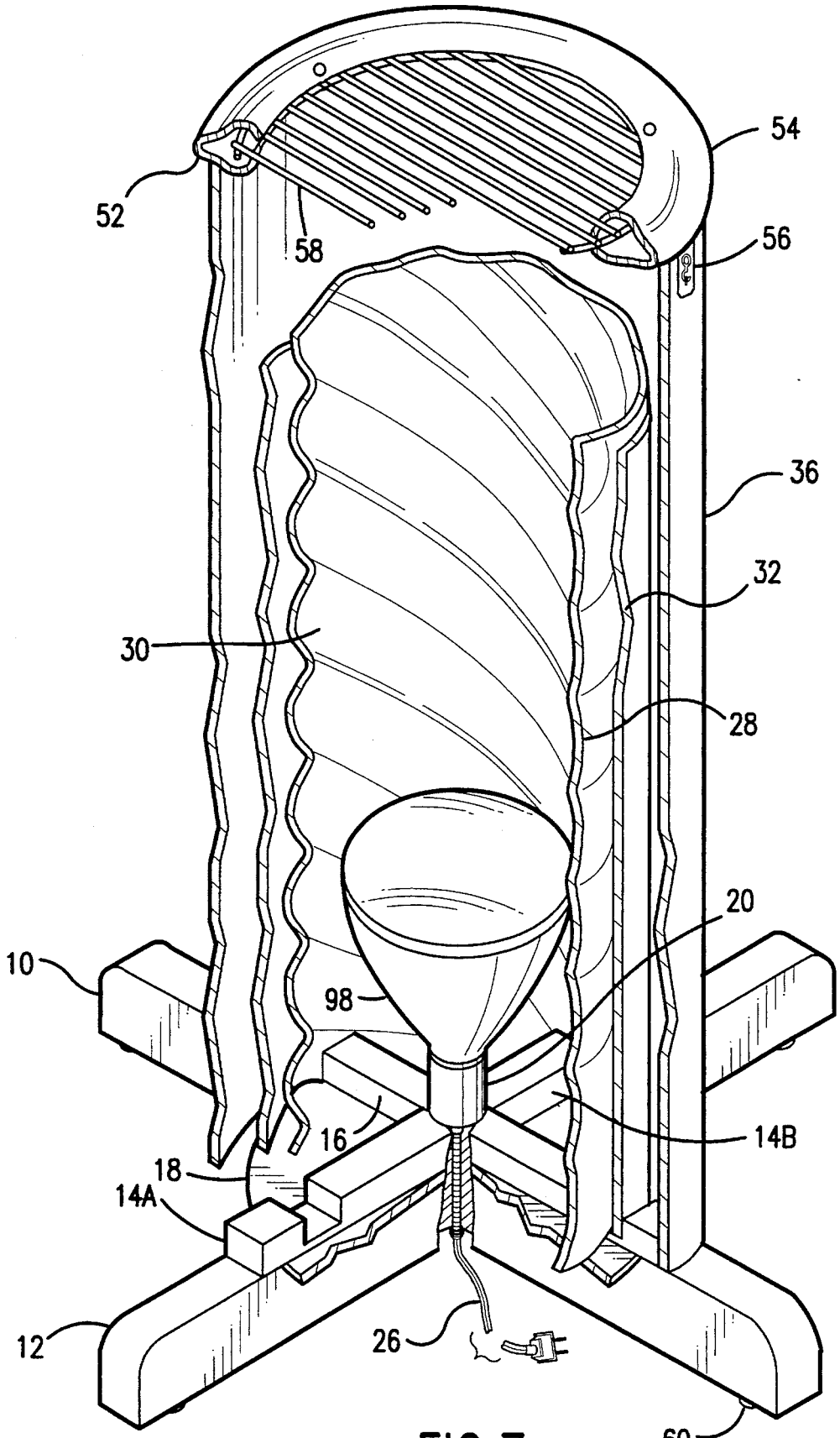
FIG. 7 shows a cut away view of the invention employing a fluorescent lamp in the floor lamp configuration.
Figure 8:
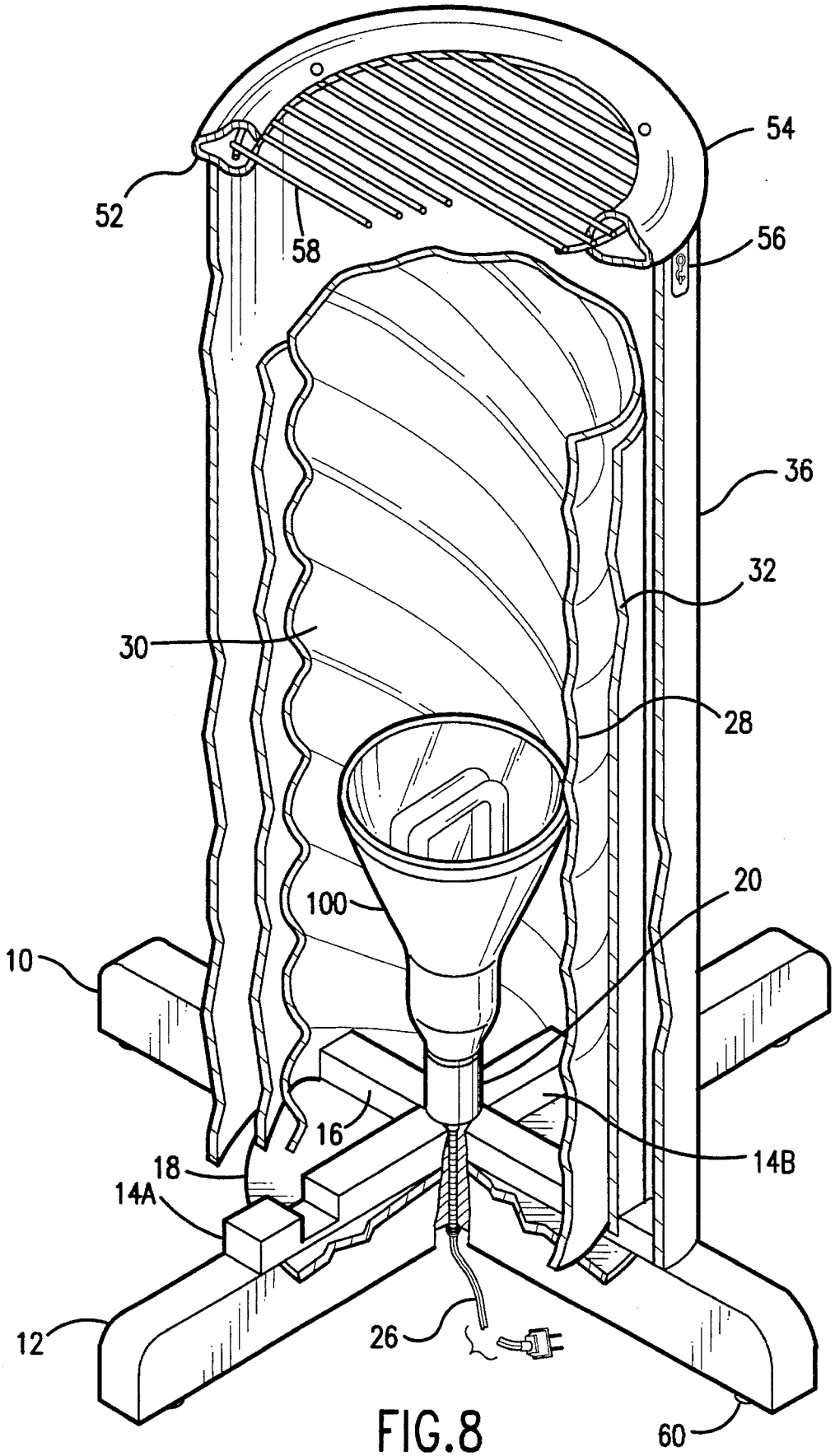
FIG. 8 shows a cut away view of the invention employing an incandescent lamp in the floor lamp configuration.

As illustrated in FIGS. 2 and 5, an upper disc 44 is attached to an outer ring 48-1 of an upper air diffuser 48 with a plurality of rivets 76. A middle disc 42 is attached to a middle ring 46-2 of a lower air diffuser 46 with a plurality of rivets 76. The entire subassembly 40 through 50 is assembled onto a threaded rod 68 with plurality of a washer 70, a washer 72 and a nut 74.

As illustrated in FIG. 2, two safety hasps 56 are secured to a lid 52 with plurality of rivets 76 opposing each other. An air outlet register 58 is placed inside lid 52 and centered. A lid 54 is placed over air outlet register 58 and lid 52. This subassembly is bolted together with a plurality of a machine screw 80, a washer 82 and a decorative nut 78.

Two safety hasp eyelets 56 are attached to outer pipe 36 with a plurality of a screw 84, a washer 88 and a nut 86. Inner pipe 28 is inserted into middle pipe 32 and secured with a plurality of a screw 96. Inner pipe 28 and middle pipe 32 are lowered onto inner pipe mounts 14A, 14B and secured in place with a plurality of screw 94. Outer pipe 36 is lowered onto the pedestals 10 and 12 and secured to outer pipe mounts 16 with a plurality of screw 92. An infrared lamp 24 is placed in porcelain lamp socket 20 from the top of the heater housing. The air diffuser subassembly, 40 through 50 is placed on the upper edge of inner pipe 28. The lid assembly 52, 54 and 58 is centered and placed on the top of outer pipe 36, aligned with safety hasps 56, and latched in place.

For lighting applications, infrared lamp 24 is replaced with an incandescent lamp 98 or a fluorescent lamp 100. The air diffuser assembly 40 through 50 is not used for this mode of operation.

From the prior description, a number of advantages of our Portable Electric Heater or Floor Lamp become evident:

(a) The lid assembly 52 and 54 has been designed to function as a 360 degree circular handle.

(b) The lid assembly 52 and 54 has been designed with a recessed air outlet register 58 that reduces accidental contact by humans or pets.

(c) The lid assembly 52 and 54 has been designed for ease of removal and installation.

(d) The outer pipe 36 remains at ambient temperature because the outer air chamber 38 provides a steady convection of near ambient air.

(e) The portable electric heater or floor lamp has been designed for mass production using "off-the-shelf" parts. No special tooling or machining is required.

(f) Other lamp sockets can be used in place of the medium base socket to accommodate lamps with higher operating voltages or different size or shape lamps with different base types.

(g) Suitable protective shielding or screening techniques, or both can be incorporated for those lamps requiring protection to people and surroundings from the possibility of a lamp shattering and from possible ultraviolet radiation.

OPERATIONS—FIGS. 1 TO 5

This Portable Electric Heater or Floor Lamp optimizes the use of electromagnetic wave radiation, thermal conduction and convection to raise the temperature and velocity of air. The heart of our invention illustrated in FIG. 1, is a reflector style infrared lamp 24 placed inside a vertically mounted inner pipe 28 that is painted with a high temperature black paint. This inner pipe 28 is corrugated, with forty five degree helical spirals, whose metal configuration, composition and density make it an ideal black body. The metal composition and density of inner disc 40, the middle disc 42 and the upper disc 44 are also ideal black bodies that convect and conduct heat efficiently.

As illustrated in FIG. 2, the air diffuser assembly 40 through 50, is designed to absorb radiant energy, emit heat energy, restrict, direct and diffuse heated air from the inner air chamber 30 to the center of the outer air chamber 38.

Figure 3:
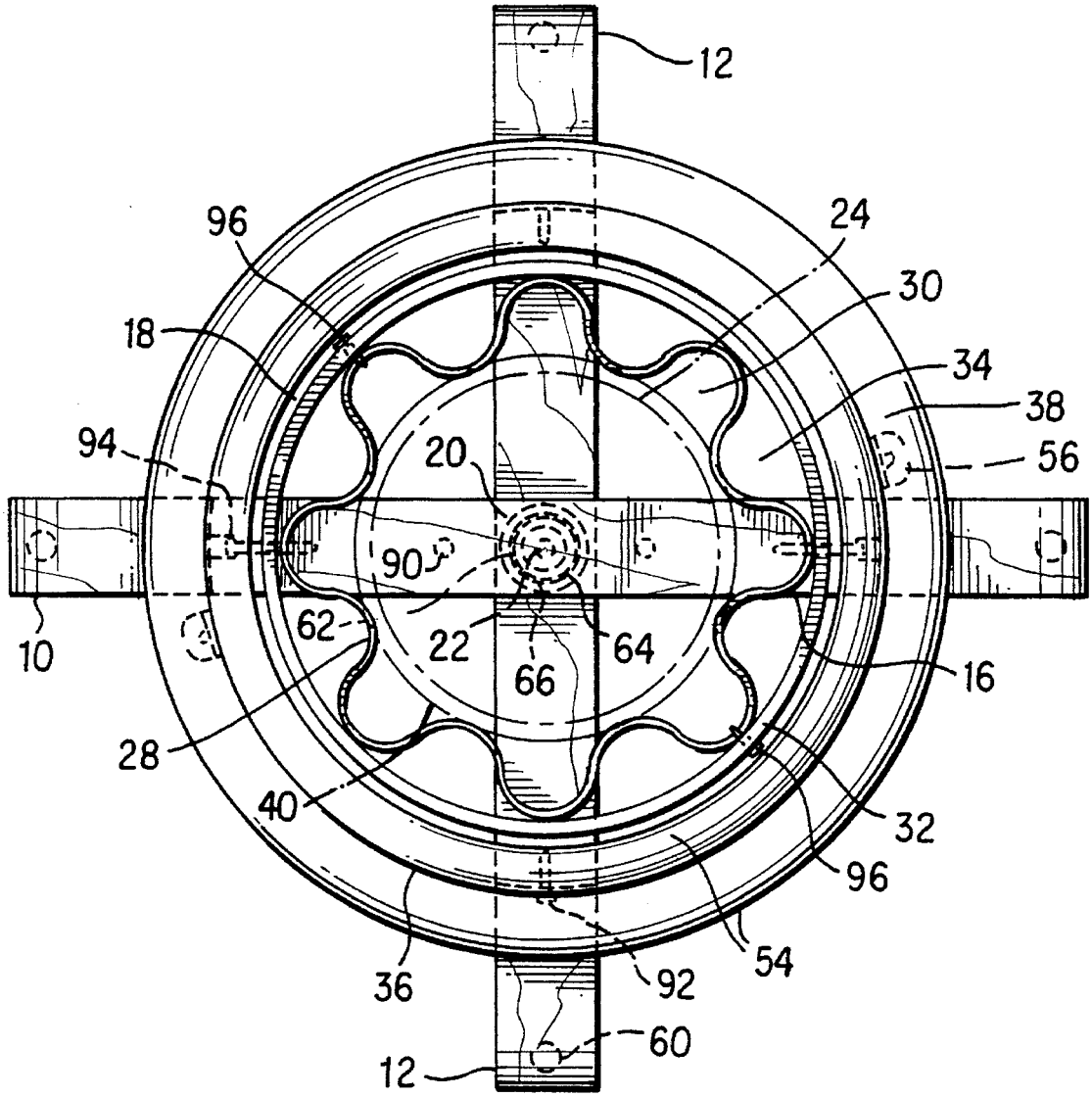
FIG. 3 shows a plan view of the invention.

The intake air diffuser 18 as illustrated in FIGS. 2 and 3, directs and controls intake air into inner pipe 28. Additional design features include the blocking of radiant energy reflected out of the bottom of inner pipe 28. The upper surface of intake air diffuser 18 can be painted a flame color that will reflect this color onto the inner surface of outer pipe 36. This gives the appearance of a glowing fire when viewed looking down into the heater.

As illustrated in FIG. 2, heat conducted to the outer surface of inner pipe 28, heats the air in a middle air chamber 34. Heat conducted to the outer surface of middle pipe 32, heats the air in an outer air chamber 38. The combined heated air from all three chambers is then directed through the air outlet register 58. The heated air is a form of kinetic energy and subscribes to the law of conservation of energy.

Infrared lamp 24 is a reflector style lamp having a coiled tungsten filament on a suitable mount, enclosed in a heat resistant hardened silica glass bulb containing a gas mixture of argon and nitrogen. When electrical current passes through the filament wire, it heats the filament to incandescence causing the filament to emit visible and infrared (heat) electromagnetic waves. The lamps energy beam spread angle is 55 degrees. The radiant and visible energy waves are traveling at the speed of light and in a straight line. The electromagnetic waves bombardment onto the interior corrugated surfaces of inner pipe 28, inner disc 40, middle disc 42 and upper disc 44 cause random molecular motion in these metals and is sensed as heat. The infrared lamps source temperature, wavelength of peak emission, radiation intensity at various wavelengths, and total radiation are related by laws of physics. Planck's Law deals with relationship of intensity, spectral density and absolute temperature. The Stefan-Boltzman Law relates that total radiation is dependent upon the fourth power of the absolute temperature. Wiens Displacement Law shows that the intensity of the wavelength of peak emission is a function of the fifth power of the absolute temperature.

These laws are all based on the characteristics of a black body. Inner pipe 28, upper, middle and inner disc 44, 42 and 40 are the ideal black bodies of our invention. A black body is an object which absorbs all electromagnetic radiation which is incidence upon it, and conversely, it emits the maximum possible heat radiation at any given temperature.

The spectral output of infrared lamp 24 is a function of the forementioned laws and is affected by the transmission properties of the type of glass used in the manufacture of these lamps. Clear silica glass lamps, selected for our invention, have a slightly higher percent of transmittance than translucent silica glass lamps. Radiation intensity generated by infrared lamp 24 and incident upon the black body surfaces 28, 40, 42 and 44 varies according to the inverse square law and Lambert's cosine law. As illustrated in FIG. 2, the physical placement of inner pipe 28, upper, middle and inner disc 44, 42, and 40 to infrared lamp 24 are ideally positioned for absorbing the maximum amount of radiant energy, and emitting the maximum amount of heat energy into inner air chamber 30.

As illustrated in FIGS. 2 and 3, the physical shape of infrared lamp 24 and it's close proximity to the inner surface of inner pipe 18 provides this preferred embodiment with a one way, air check valve. This air check valve feature enhances the restriction of the downward migration of the less dense air molecules that are already being opposed from downward migration by the denser air below the lamp. All intake air passes around the envelope of the infrared lamp keeping it cool and extending its life cycle. This intake air convects the heat being generated by the lamp into inner air chamber 30.

FIG. 5 shows another design feature of air diffuser subassembly 40 through 50. This assembly prevents the visible and infrared energy from escaping out of the top of inner air chamber 30.

The five heat sources that emit heat into the inner air chamber 30 are, the infrared lamp, the inner surface of inner pipe 28 and the surfaces of upper, middle and inner disc 44, 42, and 40. As the air is heated, it expands becoming less dense, and is pushed upward by the denser air that rushes in to take it's place. As the air gets hotter, convection currents keep the air moving as the air molecules expand and go into random and disordered motion. The upper, middle and inner disc 44, 42 and 40, have a critical physical dimension and positioning feature that restricts, controls and directs the heated air to the center of the air diffuser subassembly and into the outer air chamber 38. This partial restriction of air flow allows the air molecules to remain in the inner air chamber 30 for a longer period of time. This allows the air to increase its heat capacities that results in a greater convection and thermal up draft of heated air when mixed with the heated air from the middle and outer air chambers. The preferred embodiment is designed to operate safely if tipped over, allowing for reverse flow of the heated air.

SUMMARY

Accordingly the reader will see that the Portable Electric Heater or Floor Lamp of our invention can have many different embodiments. Other embodiments include a multiple configured, permanent or modular radiant energy to air heater with permanently affixed capabilities. Furthermore, our invention has the additional advantages in that:

- it permits the use with new metal compositions such as, plastic steel, ceramic and metals compositions and silicon carbide to obtain higher thermal efficiency.
- it provides uniform floor to ceiling temperatures by recirculating and re-heating the air which makes for a healthier environment.
- it provides for personalized zone heating as needed.
- it permits use with wind generators of electricity and photovoltaic solar cell systems due to the low wattage consumption of the infrared lamp.
- it provides use with black body surfaces that can have many and varied rough or irregular, smooth or reflective surfaces designed to absorb, reflect and emit radiant energy.

The uniqueness of our invention is the use of "off-the-shelf" materials to manufacture said invention.

Although the description above contains many specificities, this should not be construed as limiting the scope of our invention, but as merely providing illustrations of the presently conceived, designed, tested and proven preferred embodiments. For example, this invention can have other shaped embodiments that utilize the use of radiant energy to heat and circulate air by natural convection.

Thus the scope of our invention should be determined by the appended claims and its legal equivalents, rather than by the examples given.

We claim:

1. A combination portable electric heater and floor lamp comprising: a hollow heat conductive cylindrical casing of refractory materials having openings of equal cross sectional dimensions at each end of said cylindrical casing allowing air circulation therein, said casing having an inner surface of composition, density and configuration providing for the absorption and reflection of radiant energy, and having physical dimensions sized to contain a replaceable radiant energy source, a subassembly of manually detachable heat conductive discs and heat conductive air outlet diffusers of refractory materials being located at an upper portion of said casing, said replaceable radiant energy source having a bulb shape and being electrically connected to an upright base positioned in a lower region of said casing, said radiant energy source being positioned a close spacial distance to an inner surface of said casing to provide therein a thermally controlled one way air check valve, the radiant energy emitted from said radiant energy source being incident upon said subassembly and said inner surface of said casing, a support member having mounting means for said upright base and for an electrical line cord, a thermally pressurized air chamber being located in said casing between said radiant energy source and said subassembly, said subassembly having composition, density and configuration providing for the absorption and reflection of radiant energy from said radiant energy source, said subassembly having an adjustable lower disc whereby physical spacing between said radiant energy source and said lower disc may be varied to provide an optimum focus position for direct and reflected radiant energy, said subassembly including a lower air outlet air diffuser having a lower surface which provide mounting means for a middle disc and an upper air diffuser having a lower surface which provides mounting means for an upper disc, said subassembly providing substantial containment within said casing of radiant energy emitted from said radiant energy source, said subassembly having partially restricted openings which direct heated air to the center of said upper air outlet diffuser, said subassembly lower disc, middle disc and air outlet air diffusers having a center anchoring means attached to a threaded rod, said threaded rod having anchoring means attached to a knob, said support member having mounting means for an inlet air diffuser, said air inlet diffuser having a spatial distance between a lower end of said casing which regulates the volume of dense cool air entering the said casing, said subassembly air outlet diffusers, said middle disc, and said upper disc having air openings and spacing which regulate the volume of heated air exiting said casing, with the total air outlet opening cross sectional area being greater than the total air inlet opening cross sectional area, whereby total absorption of direct and reflected radiant energy from said radiant energy source is transformed ultra efficiently into molecular heat energy and is convected into said air chamber, and the air temperature, air volume, air thermal conductivity and air pressure in said air chamber increases as the air density decreases, causing said heated air to be communicated with increased velocity through said subassembly air outlet diffusers into the atmosphere.

2. The combination of claim 1 wherein:

a hollow heat conductive cylindrical second casing of refractory material is positioned to encircle said casing, said second casing having openings at both ends of equal cross sectional dimensions and a diameter greater than that of said casing to provide an open ended free flowing convection air chamber between said casing and said second casing, said second casing being mounted to said support member.

3. The combination of claim 2 wherein:

a hollow heat conductive cylindrical outer casing of refractory materials is positioned to encircle said second casing, said outer casing having openings at both ends of equal cross sectional dimensions and a length and diameter greater than that of said casing and said second casing to encircle and extend above said second casing and provide an open ended free flowing convection air chamber between said outer casing and said second casing, said outer casing being mounted to said support member, a manually detachable circular lid, handle, and recessed non-restrictive air outlet register subassembly being mounted at an upper region of said outer casing, said air outlet register subassembly having mounting and anchor means for said air outlet register, said air outlet register having a diameter equal to the outer diameter of said second casing whereby heated air from all air chambers travels through said air outlet register into the atmosphere.

4. The combination of claim 1 wherein:

said replaceable radiant energy source is a fluorescent lamp.

5. The combination of claim 1 wherein:

said replaceable radiant energy source is an incandescent lamp.

* * * * *